US005088469A

United States Patent [19]

Hargrave

[11] Patent Number: 5,088,469

[45] Date of Patent: Feb. 18, 1992

[54] PLASTIC LID LAUNCHER

[76] Inventor: Fred M. Hargrave, 408 Spencer Ave., Marion, Ind. 46952

[21] Appl. No.: 598,024

[22] Filed: Oct. 16, 1990

[51] Int. Cl.[5] ..... A63B 65/00; F41B 3/04; F41J 9/18

[52] U.S. Cl. ..... 124/5; 124/16

[58] Field of Search ..... 124/1, 4, 5, 16, 79, 124/81

[56] References Cited

U.S. PATENT DOCUMENTS

| | | | |
|---|---|---|---|
| 1,607,874 | 11/1926 | Darton | 124/5 |
| 2,493,245 | 1/1950 | Hansen | 124/5 |
| 2,586,547 | 2/1952 | Marley | 124/43 X |
| 2,945,485 | 7/1960 | Shreberg | 124/4 |
| 3,508,532 | 4/1970 | Lander | 124/4 X |
| 3,901,208 | 8/1975 | Laporte et al. | 124/5 |
| 4,157,828 | 6/1979 | Cosmopulos | 124/81 X |
| 4,549,521 | 10/1985 | Hargrave | 124/5 |

FOREIGN PATENT DOCUMENTS 600301 11/1959 Italy .

*Primary Examiner*—Peter M. Cuomo
*Assistant Examiner*—John A. Ricci
*Attorney, Agent, or Firm*—Stevens, Davis, Miller & Mosher

[57] ABSTRACT

A lid launcher toy comprises an elongated spring member having a handle at a second end and ameans for engaging a flexible plastic lid at a first end thereof. The toy lid launcher projects and imparts a spin to a lid having a top attached to a peripheral rim. A fulcrum is provided to allow the user to bend the elongated spring member to impart a force to the lid.

16 Claims, 2 Drawing Sheets

FIG. 1
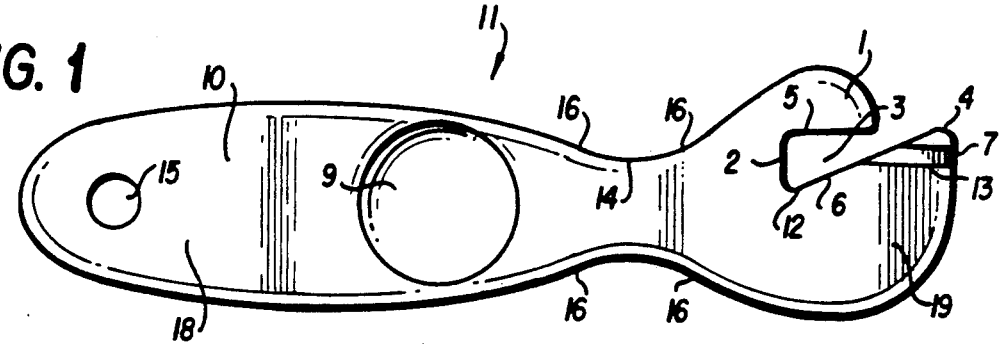
FIG. 2
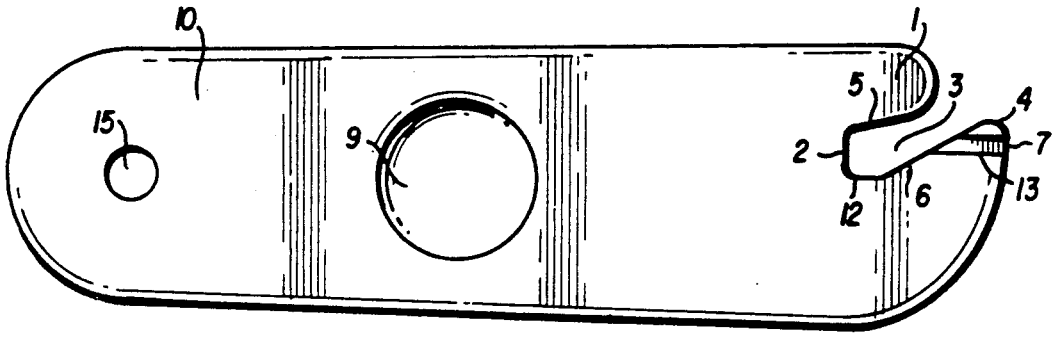
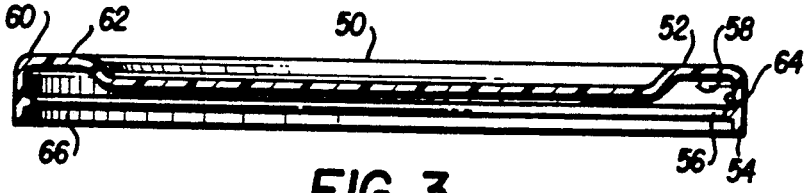
FIG. 3

PLASTIC LID LAUNCHER

BACKGROUND OF THE INVENTION

1. Field of the Invention

This invention relates to a toy that is a launcher for a plastic lid, for example of the type that often accompany metal cans of snack foods. The launcher comprises a length of elongated spring material having a lid engaging means at a first end thereof, a centrally located fulcrum for providing a point at which the launcher is bent and a second end which provides a place where fingers are placed to engage this elongated spring member.

2. Description of the Prior Art

Discs which can be thrown, for example, the frisbee, are well known in the art. These devices are thrown by hand and require a degree of user skill for accurate throwing. To provide an easier means for projecting a disc, hand held projection devices have been developed which require relatively little skill by the user. Examples of disc projecting device include U.S. Pat. Nos. 1,807,922 to La Sala et al; 2,408,984 to Lawson, Sr.; and 4,033,313 to Ryan as well as Italian Patent No. 600,301 to Rocci. This prior art discloses devices which use an elastomeric material, such as a rubber band, to propel a disc. Elastomeric materials have the disadvantage that the elastomer can break and cause an additional expense in replacement costs.

U.S. Pat. No. 2,586,547 to Marley discloses a hand trap device to toss disc-like clay pigeons, and it does not employ an elastomeric material. However, this hand trap involves considerable skill by the user to accurately project a clay pigeon.

Elongated spring materials have been employed to project objects such as spheres as disclosed in U.S. Pat. Nos. 2,243,122 to Glover et al and 3,841,292 to Hoffman. However, the apparatus disclosed by these references would not be appropriate for projecting a disc, nor imparting a spin to a projectile. Spin is important because it allows an object to be projected with greater accuracy and distance. In addition, '292 to Hoffman could be hazardous to children. It has a pointed end which could injure a child, particularly the eyes. Another disadvantage of Hoffman is that it can only project objects which have a bore hole.

U.S. Pat. Nos. 2,493,245 to Hansen and 4,277,068 to Sakaki disclose hand-held projectors which can impart spin to the disc. The Hansen patent discloses a projector comprising a handle attached to a bracket arm attached to a clamping bar which clamps onto a disc. The clamping bar pivots to throw and to impart a spin motion to the disc.

U.S. Pat. No. 4,549,521 to Hargrave discloses a flipper comprising a length of material having a lid-engaging means at a first end, a shield being adjacent to the engaging means and a handle at a second end of the spring member. The flipper engages a lid similar to the lids used in the present invention. A possible disadvantage is that the flipper could be dangerous for children. The flipper user could impart a stinging blow to another by bending the spring material and releasing it while near another.

The previously mentioned U.S. Patent to Sakaki discloses a disc projector and catcher which includes a pair of resilient pinching blades between which a flying disc is loaded. One pinching blade has a slippery edge, and the other has an opposing corner. When a thrust is provided by the pinching blades to the disc, the thrust is transformed into a torque between the opposing and slippery corners, thus imparting a spin to the disc. However, both the devices of Hansen and Sakaki have drawbacks. The Hansen device could be dangerous because the clamping bar could injure a child. In addition, the devices of Hansen and Sakaki have mechanical components which could break down.

It is thus desirable to have a simple device which can project a disc and impart a spin to the disc. Such a device should be safe to use.

SUMMARY OF THE INVENTION

According to the present invention, the lid launcher apparatus is a means for launching and imparting a spin to a lid. The launcher includes an elongated spring member having a 2nd end which is used to grasp the spring member by the user, a central fulcrum for providing a position where the spring member is bent, and a first end for engaging a lid. The lid is preferably a saucer type disc having a peripheral upstanding rim flange attached to the lid. The lid is preferably made of a flexible resilient soft plastics material and having a radially inwardly extending welt around the inside periphery of the upstanding flange. The launcher is preferably made of Lexan and has a relative short length.

It is an object of the invention to provide a lid launcher apparatus which can be hand held and used with relatively little skill to impart a spin to a lid and comprises an elongated spring material that is relatively stiff so as to protect the user from a stinging slap, thus being safe to use. The relatively short length additionally protects the user from a stinging slap.

BRIEF DESCRIPTION OF THE DRAWINGS

FIG. 1 is a side view showing the subject plastic lid launcher;

FIG. 2 is a side view of another embodiment of a plastic lid launcher;

FIG. 3 is a sectional elevational view across the diameter of a typical lid;

DETAILED DESCRIPTION OF THE INVENTION

Figure 4:
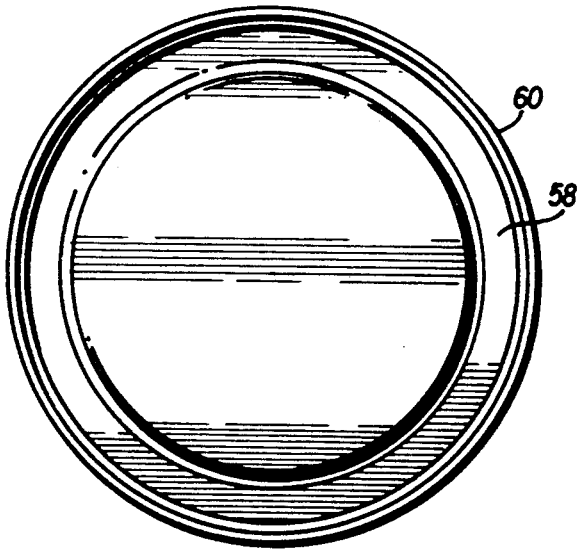
FIG. 4 is a top view of the lid.

FIG. 1 shows a preferred embodiment of the lid launcher 11 which comprises an elongated spring member 10. At one end the elongated spring member 10 has a cut out portion defining a loading slot 3 and the remaining material defines a top overhang holder 1 for pressing against the top of the lid so as to force the lower edge 54 (see FIG. 4) of rim of a lid 50 down against the bottom 12 of the loading slot 3. The elongated spring member 10 includes a centrally located fulcrum 9 for placement of the thumb of one hand which is the fulcrum for bending the elongated spring member 10. The loading slot 3 is located between the top overhang holder 1 and a lifting incline 6 which guides the spinning lid up and out of the loading slot. The spinning lid travels out from under the top overhang holder 1 and over the tip of the inside twister top 4 which positions the lid. The lid is now free to travel in free flight.

One key aspect of the invention is the contact between the launcher and the lid. The person operating the launcher engages the lid by placing the lid in the loading slot. The lid enters the loading slot along a line which is parallel to a radius of the lid. With the operator's right hand holding the launcher and with the left hand holding the lid 50, the lid is rotated about its own axis by perhaps a quarter turn. This turn results in the following simultaneous contact points: lid welt engager 7 and the radially inwardly extending peripheral welt 56 (see FIG. 3); inside twister top 4 and the top of inner shoulder 58; inside twister side 13 and the inner channel 62; the floor 12 of the loading slot and the bottom edge 54 of the flange 60; outside twister 2 and the outside of the flange 60; the top overhang holder 1 and the shoulder 64.

The simultaneous contact between the above elements is achieved when the lid enters the loading slot 3 and is pressed home therein and rotated as described above while in the loading slot 3. The above contacts allow the lid and the elongated spring member 10 to remain connected while the elongated spring member is bent with one hand, and the other hand is holding the lid 50 at the sam time the portion of the lid flange that is within the slot 3 is also locally deformed. When the elongated spring member is released from being bent, the lid 50 rises from the loading slot and achieves level and spin stabilized flight.

The horizontal length of the top overhang holder 1 is not critical but should not interfere with the lid's access to other parts of the launcher. The vertical width of the top overhang holder is similarly not critical, yet the bottom of the top overhang holder 1 and the inside twister top 4 must correspond to outside and inside respectively of the top 52 of the lid. The vertical distance between floor 12 of the loading slot and the bottom of the top overhang holder 1 corresponds generally to the vertical height of the flange 60. The width of the loading slot 3 at the center of lifting incline 6 is equal to or smaller than the vertical height of the flange 60. This narrow channel guides the lid to level flight.

Figure 5:
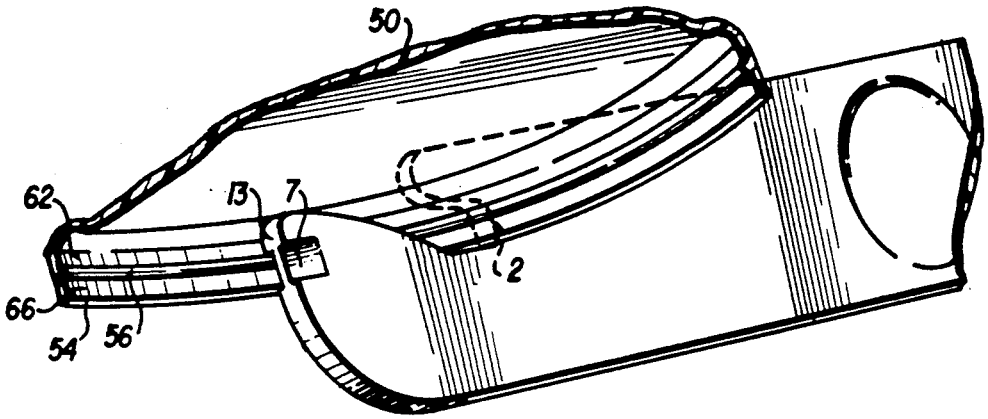
FIG. 5 is an upwardly facing oblique perspective view of the plastic lid launcher engaging a lid, the lid being shown as partial sectional view.

The inside twister side 13 engages the inner peripheral surface of the flange 60 in apposition to the outside twister 2 which engages the outer peripheral surface of flange 60. As previously described, when the lid is turned in the launcher, the inside twister 13 side applies pressure to the inner peripheral surface of the flange 60. Correspondingly, the outside twister 2 applies pressure to the outer peripheral surface of flange 60. These opposing pressures increase the frictional force between the lid and the launcher. This particular contact of the inside twister side 13 and the outside twister 2 allows the lid to remain connected with the launcher without slipping while a bending force is applied to the launcher. The remaining contact points allow the position of the lid/launcher to be maintained while the bending force is applied. The inside twister top 4 contacts the lid inner shoulder 58. The floor 12 of the loading slot contacts the flange bottom edge 54. The gently beveled edge 5 of the top overhang holder 1 engages the lid at the junction of the outside of the rim and the top of the lid. The gently beveled edge 5 of the top overhang holder 1 guides the lid under the top overhang holder 1 and presses down on the lid to aid in preventing the lid from slipping while the lid is held in the launcher. This gently beveled edge 5 is located on both sides of the top overhang holder 1 as seen in FIG. 1. The lid launcher will work equally well without the edge 5 being beveled, it can also be a square edge with gently rounded corners. The lifting incline 6 guides the lid over the inside twister 4. The lid welt engager 7 forms a channel which holds the peripheral welt 56 when the lid is turned in the launcher, and thus, the peripheral welt does not prevent the contact of the inside twister side 13 and the inner rim. Lid welt engager 7 is located on both sides of the launcher and straddles or captures the peripheral welt 56 of the lid to allow contact of the inner rim with the inside twister side 13. The lid welt engager 7 is a uniform depth channel which is approximately a thirty second (1/32) of an inch in depth and which extends from the front tip of the launcher to the loading slot. The lid welt engager 7 as in FIG. 5 is placed on both sides of the launcher to allow the launcher to be used by either the left or right hand. Increasing the length and depth of the lid welt engager 7 minimizes the distortion of the inner lid and results in a secure lid to aid in launcher/lid contact.

Referring now to FIG. 1, the launcher in a preferred embodiment includes a narrowed area section 14, which is about one-half the width of elongated spring member 10. This narrowed area section 14 is located directly behind the outside twister 2. The narrowed area section 14 includes a taper 16 which achieves a reduction in the width of the elongated spring member 10.

After the launcher is bent and released, the elongated spring member 10 returns to its normal unbent position. As this spring member returns, the lid 50 is propelled forward, and a lateral force is generated by a left to right movement of the tip (this is for a right handed user) as the elongated spring member 10 returns to its normal position.

The narrowed area section 14 results in improved accuracy by minimizing the lateral force vector created by the spring body member 10 returning from a bowed to a straight condition when released. Additionally, a longer elongated spring member 10 results in greater generated lateral force.

The narrowed section 14 which occurs in front of the thumb fulcrum point 9 causes the elongated spring body 10 to have a double stage spring effect. The lid is subject to the double stage spring effect which is two different forces which virtually eliminate the lateral force. This is achieved as follows. As the elongated spring member returns to its normal position, the narrowed area section 14 causes rear section 18 to return to its normal position faster and more forcefully than front section 19. Because front section 19 lags rear section 18, the right lateral travel of lid 50 is virtually eliminated if the ball of the thumb is essentially at the mid point of the elongated spring member 10 and the elongated spring member is normally pulled back or bent.

The narrowed area section 14 permits trajectory alteration and corrections to be made by moving the thumb fulcrum point 9 forward or backward to adjust for straight flight at varying degrees of elongated spring body 10 "pull back". As shown in FIG. 1, the thumb may be positioned anywhere on the thumb fulcrum line 17 to achieve trajectory alteration and correction.

The launcher is preferably constructed of material that has good bending characteristics. This material must be deformable by the pressure exerted on the launcher and must be able to return to its original shape, i.e. have a "spring" capability. Preferably, the launcher is made of a plastic material such as Lexan which is a polycarbonate. Polycarbonates have outstanding impact strength, good heat resistance, transparency, dimensional stability, electrical resistance, resistance to oil, resistance to chemicals and resistance to solvents.

The launcher may project a wide variety of discs, and the particular engaging mechanism will vary to conform to the particular disc. However, most discs or lids share some common characteristics. As described above, most lids 50 have an inwardly extending peripheral welt 56 on the inner periphery of the flange 60. The flange 60 is circular and is upstanding, that is perpendicular to the plane of the top of the lid and forms the outsided perimeter of the lid 50. The lower edge 54 of the flange is located on the bottom of the flange 60 as viewed in FIG. 3. In this example, the lid 50 has an inner channel 62 which is circular and has a diameter of approximately 2¾ inches and which is on the inside surface of the flange 60 above the peripheral welt 56. The peripheral welt 56 is on the inside of the flange and about ⅛ inch from the edge 54 of the flange. The width of the inner channel 62 is approximately ⅛ inch, and the peripheral lip projects out about 1/32 inch thick from the inside of the flange. An inner channel 62 is located on the inner surface of the flange 60 in a plane perpendicular to the top 52 and is positioned between the peripheral welt 56 and the top 52. The top 52 of the lid has an inner shoulder 58 which is a ring-like member and which forms the outer perimeter of the lid top, and the top 52 is integral with the flange 60.

The lid 50 is made of plastics material which is soft and which is light enough not to harm people it may contact in flight. However, the plastic is resilient so that the lid may be launched without damaging the lid. The lid could be constructed of rigid material without affecting it's flight characteristics. The lid launcher could be adapted to launch any size lid.

The loading slot is located between the top overhang holder 1 and lifting incline 6.

Figure 6:
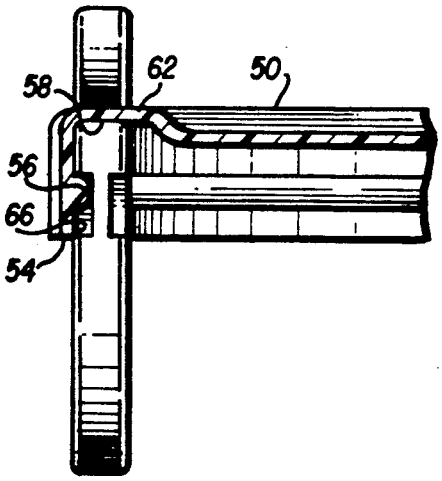
FIG. 6 is a cross-sectional view of another embodiment of the lid.

FIG. 6 best shows the engagement between the lid and the launcher. It also shows another embodiment of the lid. The top of the peripheral welt 56 and the inner shoulder 58 is enlarged in this embodiment.

EXAMPLE

The following procedure is used to launch a lid. The launcher is held in the right hand, and the lid is placed into the launcher by the operator. The thumb of the right hand is placed on the fulcrum 9. The left hand holds the lid 50 by the index finger and by the thumb and forms a pinch grip. The right index finger and the second finger engage the first end of the launcher. The left hand draws the lid back; the right hand pushes the launcher forward at the fulcrum 9; or both hands act together. The result of the above operation is that the launcher is bent, and the lid is locally deformed at the points of engagement with the launcher. The amount of deformation varies with the stiffness of the material. Specifically, the launcher bends at a point between the engaging point of the inside twister side 13 and fulcrum 9 and continuously between the first end and the fulcrum 9. The launcher is bent in an arc about the fulcrum 9. The bent launcher and the engaged lid are initially in the horizontal position and are substantially perpendicular to the chest of the operator. After releasing the index finger/thumb pinch grip of the left hand, the bent launcher springs straight and releases the stored energy of the launcher. During the release, the tip of the launcher travels forward and right covering about 45° to 60° of an arc subtracted from the point of launch. This release results in vectors of force being generated to propel the lid not only to the front but also to the right. The result is similar to hurling a stone from a whirling sling or striking a golf ball while the club face is moving from "in to out" or "out to in". The travel of the golf ball results in either a "hook" or a "slice". Similarly, the lid will fly straight, right, or both to the front and right. This force is partly transferred to the lid 50, and the force causes the lid to leave the launcher to achieve straight and level spinning flight. This force results primarily from the energy stored in the elongated spring member 10, but additional energy is stored in the lid which is deformed and in the tendency of the thumb which is positioned on the fulcrum to "push" the elongated spring member 10. Specifically, before the lid is released, the lid and the launcher travel together as the launcher substantially returns to its original unbent position. This is accomplished at a relatively high rate of speed. When the launcher reaches its original unbent position, the launcher will further bend in the opposite direction only to a small degree which is due to inertia. The launcher is constrained from further movement by its relatively rigid nature. Because the launcher is bent about a fulcrum 9, the launcher and the lid will travel in an arc. When the launcher reaches its original position, the inertia of the moving lid causes the lid to continue to move substantially in the direction of the arc. Since the launcher has engaged and holds the edge of the lid, the force imparts a torque to the lid which causes the lid to spin. Additionally, the force which causes the lid to spin and which imparts a front and right force to the lid causes the lid to travel away from the launcher. The launched lid may fly wide of the intended target. A greater bent angle creates a greater bending force which results in lid flight which is more to the right. The reverse results for left hand users.

In addition, a longer launcher or a fulcrum which is moved towards the back of the launcher increases the right deflection. The reverse results for left hand users.

A small launcher which is approximately 4⅛" long will shoot straight whether pulled back by a small amount or by a large amount (provided, of course, that the lid is held horizontally when discharged). The force to the right is small and does not substantially affect the lid flight. A lid which is tipped either left or right will bank and turn toward the side of the lid which is tipped down. This is similar to an airplane in flight. With a launcher of longer dimensions, optimum accuracy is obtained by varying the length of the spring member by varying the position of the fulcrum or by varying the amount of pullback. This position change in the fulcrum point changes the relative length of the spring member of the launcher which changes the accuracy. Likewise, varying the amount of pullback changes the forces affecting the flight of the lid and hence the accuracy. After a short period of play and use, a child (or adult) will learn to obtain the best thumb (fulcrum) position and amount of pullback to achieve the desired distance and accuracy. A wider more egg-like bulbous profile launcher results in additional structural strength. As a consequence, thinner plastic may be used. A mirror image of the disclosed launcher would create a left handed launcher. If the lid launcher and lid are inverted, the lid when launched will loop, in an open spiral fashion.

I claim:

1. A lid launcher for launching into free flight a circular planar lid having upper and lower surfaces and a peripheral upstanding flange, said flange having radial inner and outer surfaces, said launcher comprising:

an elongated spring member of a shape and size to be held by an operator's hand;

said member having an opening at one end to receive said peripheral upstanding flange;

said opening having a first edge projecting over said flange for engaging the upper surface of said lid adjacent said flange and a second edge projecting under said flange for engaging the lower surface of said lid radially inwardly of said flange.

2. A lid launcher as in claim 1 including means on said opening for engaging the outer radial surface of said flange.

3. A lid launcher as in claim 2 including a top overhang holder for positioning said lid in said engaging means.

4. A lid launcher as in claim 2 wherein said engaging means comprises an outside twister for providing a second contact point with said lid providing increased pressure to said lid.

5. A lid launcher as in claim 1 in which the second edge is longer than the first edge.

6. A lid launcher as in claim 1 wherein said elongated spring member comprises a narrowed area section for increasing the bending angle of said elongated spring member.

7. A lid launcher as ian claim 6 wherein said elongated spring member comprises a rear section, a narrowed front section, said rear section and said front section being separated by said narrowed area, said front section providing a weaker bending force to said elongate spring member and said rear section providing a stronger bending force, said weaker and said stronger bending force counteracting a lateral force caused by said elongated spring member returning to an unbent position.

8. A lid launcher as in claim 1 wherein said elongated spring member comprises a thumb fulcrum position for placing a thumb of a hand, said elongated spring member being bent against said thumb.

9. A lid launcher for imparting a force to launch a lid into flight, said lid having an upper planar surface and a lower planar surface and a peripheral upstanding flange, said lid launcher comprising an elongated spring member for imparting a force to said lid and a slot means for holding said lid in said launcher, said slot means having a first edge projecting over said flange for engaging the upper surface of said lid adjacent said flange and a second edge projecting under said flange for engaging said lower surface radially inward of said flange, said elongate spring member comprising a fulcrum for bending said elongated spring member by a finger or thumb of a hand wherein said loading means comprises means for engaging said lid such that said lid is held by friction with said elongated spring member and wherein said elongated spring member comprises a rear section and a front section, said front and rear sections being flexible, said rear section and said front section being separated by a narrowed area, said front section being bendable by a weaker bending force than said rear section, said bending force counteracting a lateral force caused by said elongated spring member returning to an unbend position.

10. A lid launcher as in claim 9 wherein said loading means comprises a loading slot for allowing the entry and exit of said lid from said engaging means.

11. A lid launcher as in claim 9 wherein said loading means comprises an inside twister top for positioning said lid in said engaging means.

12. A lid launcher as in claim 11 wherein said loading means comprises an inside twister side for providing a first contact point with said lid providing increased pressure to said lid.

13. A lid launcher as in claim 9 wherein said elongated spring member comprises a thumb fulcrum position being movable to adjust said lateral force.

14. A lid launcher for launching into free flight a circular planar lid having upper and lower surfaces and a peripheral upstanding flange, said flange having radial inner and outer surfaces, said launcher comprising:

an elongated spring member of a shape and size to be held by an operator's hand; and said member having an opening at one end to receive said peripheral upstanding flange;

means on said one end for engaging the inner radial surface of said flange;

said opening having a first edge for engaging the upper surface of said lid adjacent said flange and a second edge for engaging the lower surface of said lid radially inwardly of said flange.

15. A lid launcher as in claim 14 wherein said lid to be launched includes a radially inwardly extending welt on the radial inner surface of said flange and said engaging means comprises a lid welt engager to receive a peripheral welt of said lid.

16. A lid launcher as in claim 14 wherein said first edge comprises a gently beveled edge for engaging the top of the lid.

* * * * *